United States Patent [19]

Catalayoud et al.

[11] Patent Number: 4,996,019

[45] Date of Patent: Feb. 26, 1991

[54] STORAGE CONTAINER FOR RADIOACTIVE WASTE

[75] Inventors: Louis Catalayoud, Cherbourg; Michel Gerard, Tourlaville, both of France

[73] Assignee: Cogema Compagnie Generale des Matieres Nucleaires, Velizy Villacoublay, France

[21] Appl. No.: 448,553

[22] Filed: Dec. 11, 1989

[30] Foreign Application Priority Data

Dec. 12, 1988 [FR] France ..... 88 16337
Jun. 16, 1989 [FR] France ..... 89 08050

[51] Int. Cl.[5] ..... G21C 19/00

[52] U.S. Cl. ..... 376/272; 376/459; 250/506.1; 250/507.1; 250/517.1; 252/633

[58] Field of Search ..... 252/633; 376/272, 459; 250/506.1, 507.1, 517.1

[56] References Cited

U.S. PATENT DOCUMENTS 4,259,912 3/1981 Fleischer et al. ..... 252/301.1
4,491,540 1/1985 Larker et al. ..... 252/628
4,567,014 1/1986 Popp et al. ..... 376/272
4,594,513 6/1986 Suzuki et al. ..... 250/506.1
4,754,894 11/1988 Simon et al. ..... 220/256
4,784,802 11/1988 Mallory et al. ..... 252/633

*Primary Examiner*—Brooks H. Hunt
*Assistant Examiner*—Ngoclan T. Mai
*Attorney, Agent, or Firm*—Pearne, Gordon, McCoy & Granger

[57] ABSTRACT

In order to ensure a good seal and a good resistance to shocks and corrosion, without increasing their cost, radioactive waste storage containers are completely made from metal fiber-reinforced concrete. This material is used for producing by molding a drum (210) and a cover (212), as well as a keying joint (224) by which the cover is fixed to the drum. At least one dovetail keying groove is formed in the junction zone between the drum and the cover. Advantageously, a filling material of the same nature as that in which is formed the container is injected into the latter, so as to form a homogeneous block.

20 Claims, 4 Drawing Sheets

STORAGE CONTAINER FOR RADIOACTIVE WASTE

Figure 1:
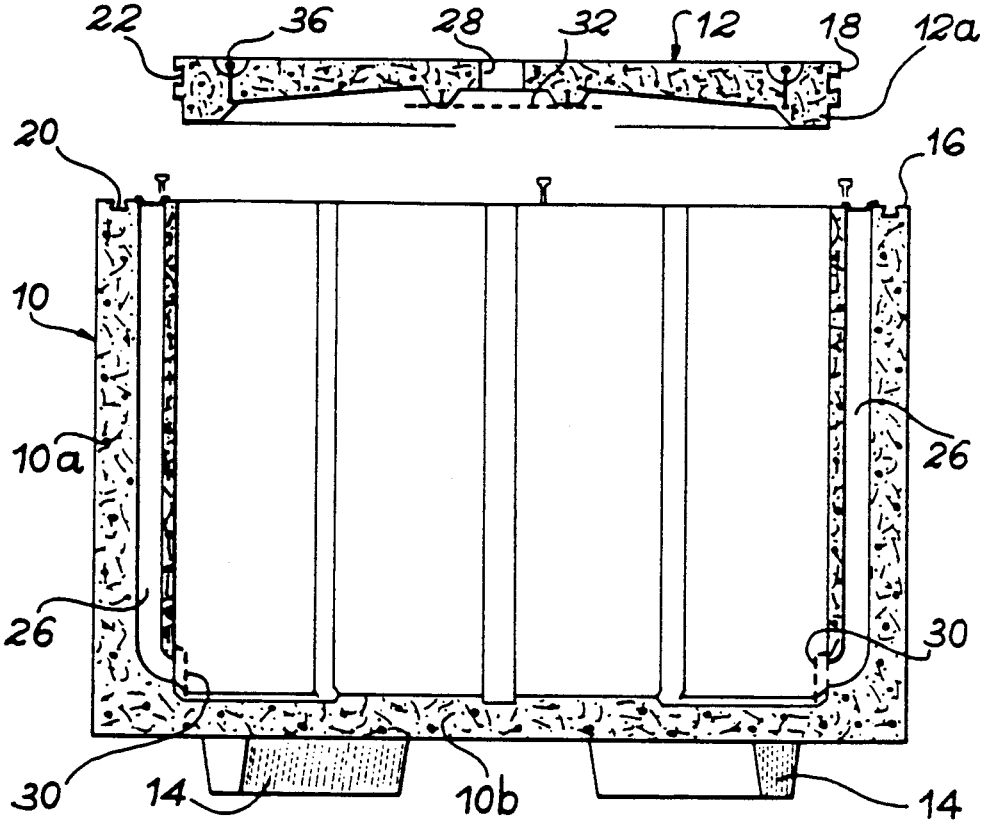

The invention relates to a storage container for receiving low or medium activity radioactive waste embedded in a filling material.

Radioactive waste storage containers generally comprise a drum and a cover able to seal said drum. When the radioactive waste has been placed in the drum, the cover is put into place and joined to the drum, e.g. by means of a joint ensuring the confinement of the container. The filling material is then injected into the container by an injection tube or passage provided for this purpose.

In the present state of the art, the storage containers are made from concrete, combined with metal fittings generally made from iron-reinforced concrete with a thickness of at least 6 mm. In a structure of this type, the rods constituting the fitting are located at a minimum distance, generally at least equal to 25 mm, from the surface of the drum or cover. The connecting zone between the drum and the cover, which has a joint which can e.g. be made from cement or resin, consequently forms a fitting-free zone, whose thickness is at least equal to 50 mm. This zone has a modulus of elasticity different from that of the other parts of the container constituted by concrete and fittings and a reduced strenght. Therefore cracks and fractures may occur in this zone, particularly under the effect of differential expansions or handling shocks.

Very dense concrete types exist, whose use would make it possible to solve these problems. However, such concrete types are too expensive for their use to be envisaged in this case.

In addition, e.g. EP-A-0 248 693 discloses concretes incorporating metal fibers.

As illustrated by GB-A-2 023 056, an irradiated nuclear fuel rod can be coated with a metal fiber-reinforced concrete. However, this is a coating produced in a single operation, which does not solve the problem of the connection between the drum and the cover, when the latter has to be fixed to the drum following the introduction of the radioactive waste into it.

The invention specifically relates to a container for the storage of radioactive waste designed in such a way as to have a homogeneous structure, even in the connection zone between the drum and the cover, so that it is resistant to shocks and corrosion, while still having a satisfactory seal with respect to air and water and having a relatively low cost.

According to the invention, this result is obtained by means of a radioactive waste storage container comprising a drum having a waste introduction opening and a cover for the tight sealing of said opening, said container being characterized in that it is completely made from concrete reinforced by metal fibers, including in the junction zone between the cover and the drum, said junction zone having, around said opening, at least one keying groove.

The metal fibers used for reinforcing the concrete are, for example, steel, cast iron, stainless steel or galvanized steel fibers.

It is advantageous to use a filling material formed by metal fiber-reinforced concrete, so that the container filled with waste and said material constitute a monolithic block.

In a first embodiment of the invention, the container comprises at least one keying joint, which is also made from metal fiber-reinforced concrete and which simultaneously penetrates the keying grooves formed in the drum and on the cover.

In a second embodiment of the invention, the cover is directly cast on the drum and penetrates a keying groove formed in the drum.

In a third embodiment of the invention, in the junction zone between the cover and the drum, there is a metal fiber-reinforced concrete keying joint, cast into a dovetail space formed between an outer peripheral edge of the cover and an inner peripheral edge of the drum surrounding the opening of the latter. The latter embodiment simplifies the procedure of sealing the drum, because sealing can be carried out without it being necessary to produce a formwork.

Advantageously, the cover has at least one filling passage internally provided with a keying groove and by which the metal fiber-reinforced concrete can be injected around the waste previously placed in the container.

Figure 2:
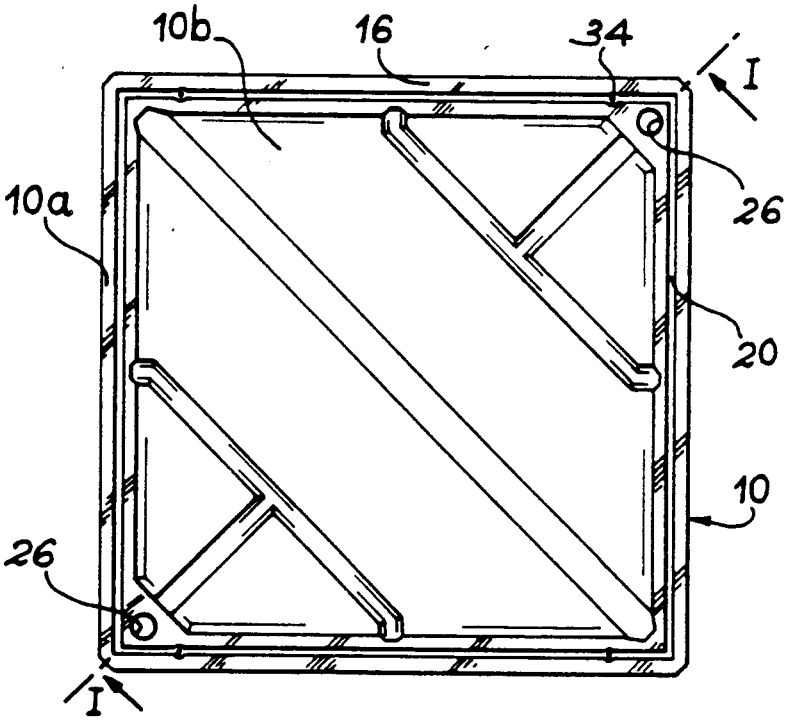

The invention is described in greater detail hereinafter relative to three non-limitative embodiments and the attached drawings, wherein show:

FIG. 1 A vertical sectional view along line I—I of FIG. 2 showing the drum and the cover of a container produced in accordance with a first embodiment of the invention, prior to the fitting of a keying joint connecting these two parts.

FIG. 2 A plan view of the drum shown in FIG. 1.

Figure 3:
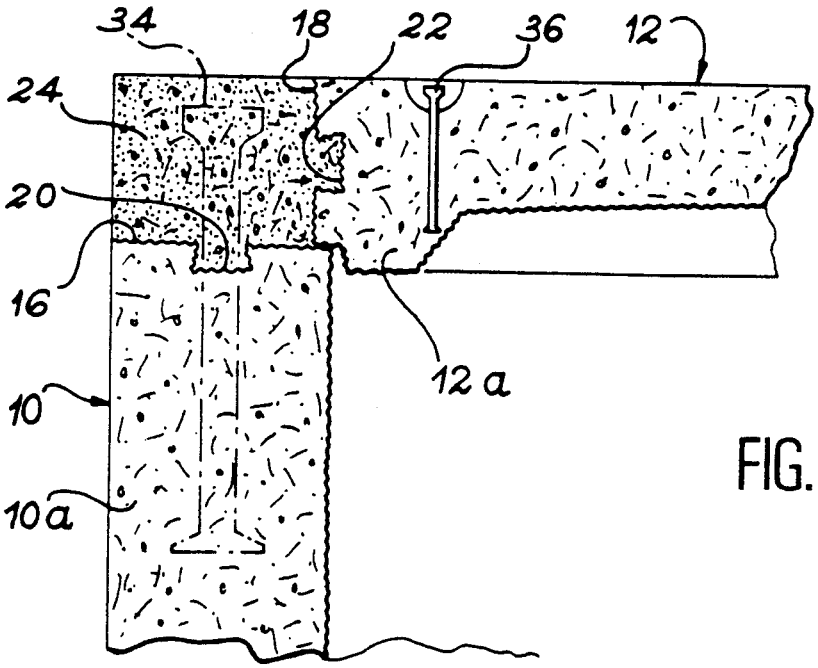

FIG. 3 A vertical sectional view showing on a larger scale the junction zone between the drum and the cover of the container of FIGS. 1 and 2, prior to the fitting of the keying joint.

Figure 4:
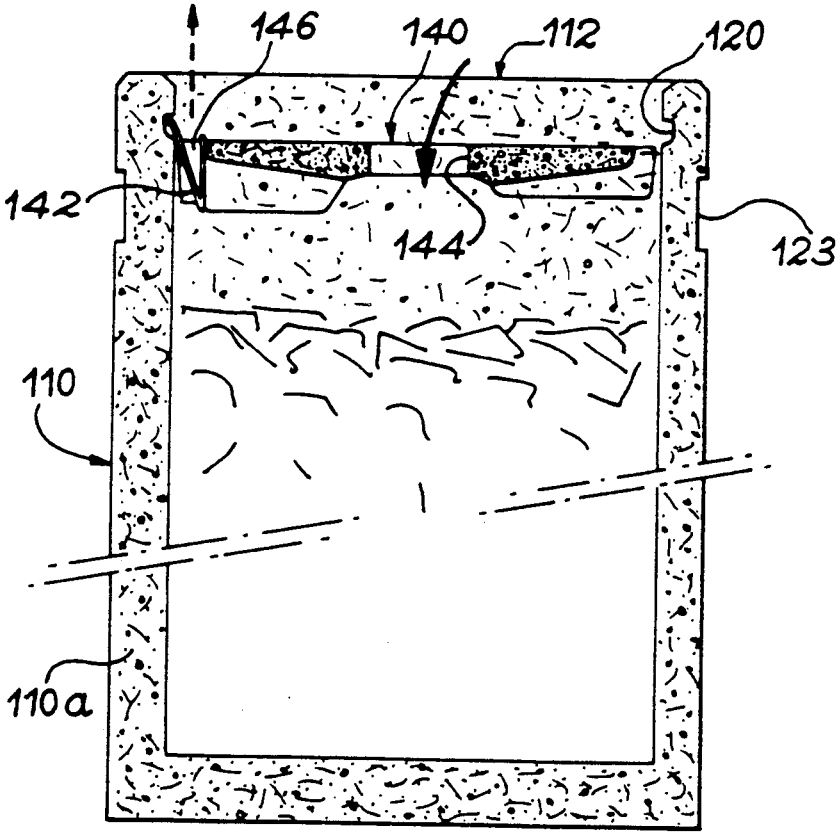

FIG. 4 A vertical sectional view showing a container produced according to a second embodiment.

Figure 5:
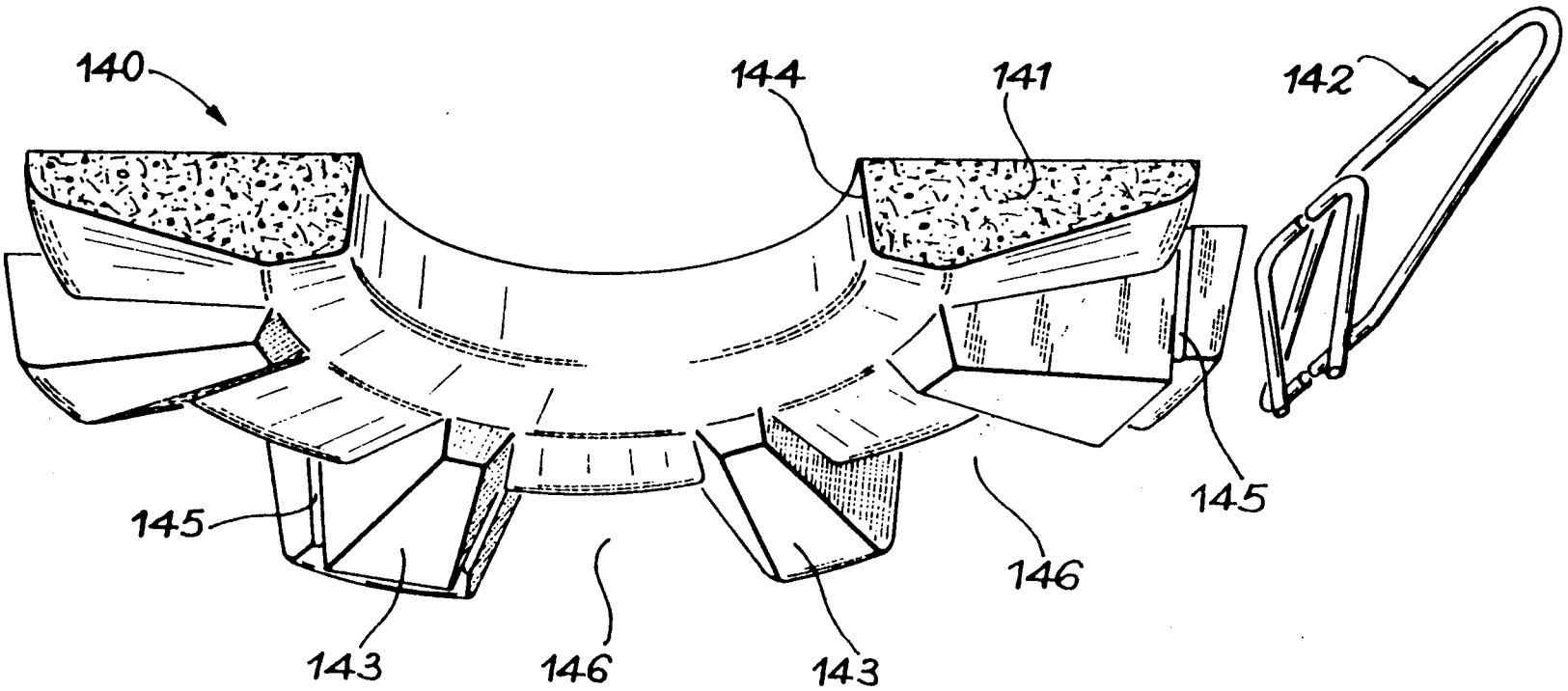

FIG. 5 A perspective view of the fly-off preventing plate of the container of FIG. 4.

Figure 6:
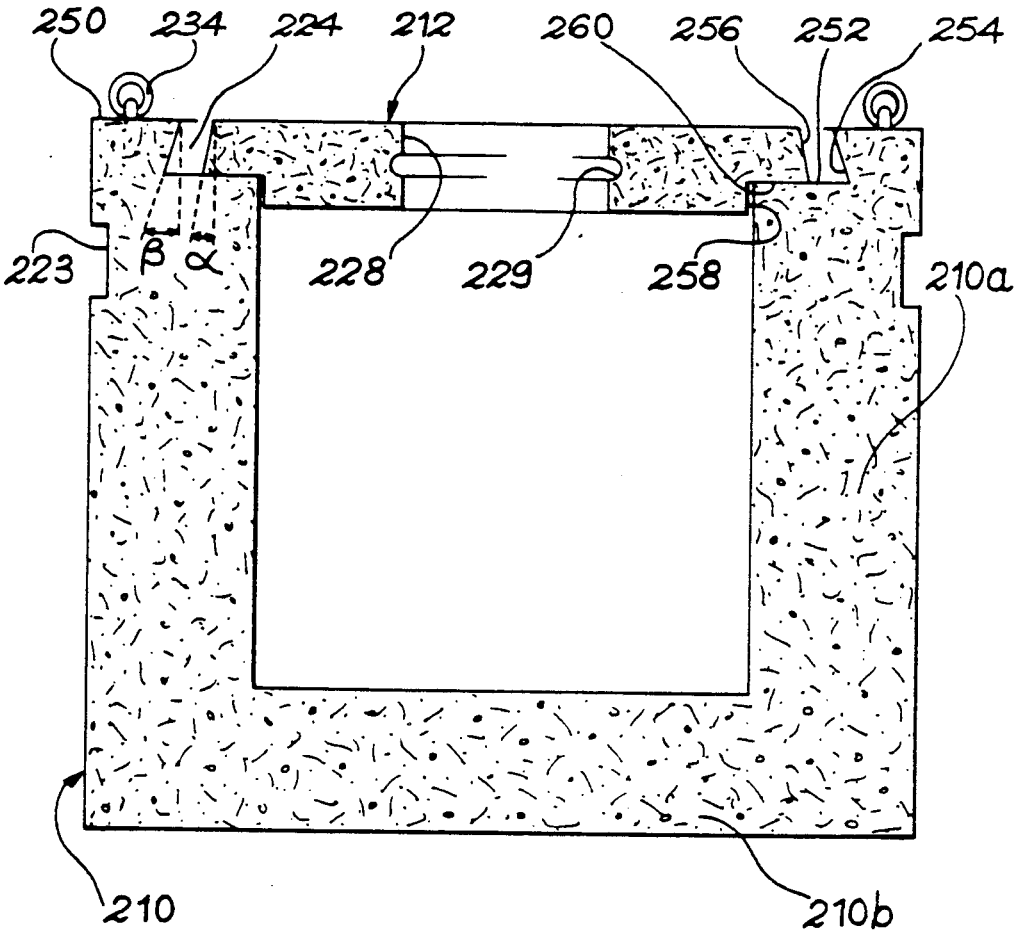

FIG. 6 A vertical sectional view of a container according to a third embodiment of the invention.

In FIGS. 1 and 2, the reference 10 designates in general terms a drum which, in this case, is shaped like a parallelepiped with a square-section. Drum 10 comprises a side wall 10*a* and a bottom 10*b*. At its upper end, the side wall 10*a* defines an opening which can be tightly sealed by a cover designated in general terms by the reference 12 in FIG. 1. The drum 10 associated with the cover 12 constitutes, when they are tightly connected in a manner to be described hereinafter, a storage container in which is placed low or medium activity radioactive waste.

According to an essential feature of the invention, the complete container, namely the drum 10 and the cover 12, is made from concrete reinforced by metal fibers. The metal fibers, which can in particular be cast iron, steel or stainless steel fibers, are uniformly distributed in a random manner within the concrete, while making it possible to reinforce the latter, while giving it a homogeneous character up to the surface. The modulus of elasticity of the container is consequently identical at all points, so that the cracks which normally appear on concrete containers internally reinforced by metal requirements are eliminated and the risk of the container cracking when dropped no longer exists. Drum 10 and container 12 are produced by molding or casting, so that they can be given any appropriate shape.

According to FIG. 1, the bottom 10*b* of drum 10 has support feet 14, possibly removable, which project beyond the outer surface of the bottom, so as to permit the handling of the container by a lifting apparatus.

Moreover, the molding of the drum 10 and the cover 12 is carried out in such a way that the inner surfaces of the container are rough and e.g. have cavities. The upper edge 16 of the lateral partition 10*a* of the drum, as well as the peripheral edge 18 of the cover 12 also have rough surfaces. Moreover, keying grooves 20 and 22 are formed on the edges 16 and 18, respectively around the opening of the drum and around the cover. The width of the keying grooves 20 and 22 increases on moving away from the surfaces of the edges in which said grooves are formed, so that in section these grooves have dovetail or trapezoidal shapes.

As illustrated by FIGS. 1 and 3, the dimensions and shape of the cover 12 are such that a lower part 12*a* of the latter penetrates the opening formed at the top of drum 10 in order to ensure the positioning and centering of the cover on said drum. Above said part 12*a* of cover 12, the peripheral edge 18 thereof in which is formed the keying groove 22 has a slightly larger size than that of the opening formed in the drum.

The tight connection of the drum to the cover is ensured by a keying joint 24, also made from concrete reinforced by metal fibers of the same nature as those of drum 10 and cover 12. The keying joint 24 is produced by molding and penetrates the keying grooves 20 and 22, as illustrated by FIG. 3. It is located both in the extension of side wall 10*a* of the drum and in the extension of cover 12 and adheres perfectly to their edges 16 and 18 as a result of the roughness of the latter.

When the keying joint 24 is formed, the container according to the invention constitutes a homogeneous, tight assembly, in which there is no discontinuity, even in the junction zone between the cover and the drum. This observation has been confirmed by tests, which have shown that if the container is dropped on a corner, in the junction zone there is only a slight surface crumbling, which does not have any consequence with respect to the air and water sealing, or the preservation of the confinement.

In the embodiment shown in FIGS. 1 to 3, the waste to be stored is placed in drum 10 and then cover 12 is fitted. Into the container is then injected a filling material, preferably constituted by concrete reinforced by metal fibers of the same composition as the concrete forming the container.

In the represented embodiment, injection takes place by at least one of two vertical tubes 26 embedded in the concrete of drum 10 in two opposite angles of the latter. These two tubes 26 issue onto the upper edge of the side wall 10*a* of the drum and within the latter, immediately above the bottom 10*b*.

During said injection, air and gases are discharged by a vent 28 (FIG. 1) e.g. formed in the center of cover 12. On the side turned towards the inside of the container, tubes 26 and vent 28 are protected by grids 30 and 32 preventing waste from entering the same.

The keying joint 24 is put into place prior to tightly joining the cover 12 to drum 10, in the manner described hereinbefore and then filling is carried out.

As is more particularly shown in FIGS. 1 and 3, drum 10 and cover 12 respectively have on their upper faces rods 34 and 36 permitting their handling by means of an appropriate installation.

In the embodiment shown in FIGS. 4 and 5, the storage container according to the invention comprises a cylindrical drum 110 and a cover 112 cast in the upper opening of the drum following the filling of the latter. More specifically, the opening formed in the upper part of the cylindrical lateral partition 110*a* of drum 110 has a keying groove 120 with a semicircular cross-section.

In this embodiment, drum 110 is firstly produced by molding or casting a concrete reinforced by metal fibers in the same way as in the first embodiment. This molding makes it possible to obtain both groove 120 and a slot 123 formed on the outer peripheral surface of the lateral partition 110*a*, in order to permit the handling of the drum.

Low or medium activity radioactive waste is then placed in the drum 110. In the embodiment shown, said waste is less dense than the filling material, so that a fly-off preventing plate designated in general terms by reference 140 is latched into groove 120 by means of springs 142 or equivalent members. Plate 140 is also made from concrete reinforced by metal fibers and has an identical composition to that of the concrete forming the drum 110.

As is more specifically illustrated by FIG. 5, the fly-off preventing plate 140 is generally shaped like a disk 141, whose external diameter is smaller than the diameter of the opening formed in the upper part of the cylindrical partition 110*a* of the drum. Disk 141 is provided in its center with a circular passage 144 by which the filling material is injected into the drum. As hereinbefore, said filling material is preferably constituted by concrete reinforced by metal fibers and having the same composition as the concrete of drum 110. In order that filling takes place in a satisfactory manner, the drum 110 is then placed on a vibrating table.

The lower face of disk 141 is slightly upwardly inclined on moving towards its outer peripheral edge, in order to facilitate during filling the escape of air and gases through passages 146 formed on the periphery of the disk, between radial portions 143 of the fly-off preventing plate 140. These portions 143 in particular ensure the centering of the plate in drum 110. Moreover, every other radial portion 143 has lateral grooves 145 for fixing one of the springs 142 by embedding.

Each of the springs 142 is in the form of an elastic metal wire having two portions shaped like an isosceles trapezium and which are connected by their small base. One of these portions having relatively small dimensions is fitted onto the projecting end of one of the radial portions 143 of the fly-off preventing plate, in such a way that its lateral branches penetrate the grooves 145. The second portion shaped like an isosceles trapezium of spring 142 and having larger dimensions is located in a plane which is then outwardly inclined, in such a way that the large base of said second portion is located in drum groove 120.

When the portion of the drum located below the fly-off preventing plate 140 is filled with concrete, the cover 112 is directly molded above said plate, so as to be flush with the upper edge of the lateral partition 110*a* of the drum, while filling the keying groove 120 and coming into close contact with the internal surface of the drum opening.

According to the invention, cover 110 is also made from metal fiber-reinforced concrete, in such a way that the said container constitutes, as in the previous embodiment, a homogeneous, tight assembly having a uniform modulus of elasticity and consequently in which cracks and fractures appearing with the prior art containers are eliminated. The container structure also gives it a good resistance to corrosion.

Preferably, as in the previously described embodiment, the internal surfaces of the drum 110 and the surfaces of the fly-off preventing plate 140 are rough, so as to permit a good adhesion of the concrete, which is then cast against these surfaces.

A third embodiment of the invention will now be described relative to FIG. 6. In FIG. 6, reference 210 designates in general terms a drum to be tightly sealed by a cover 212, in order to form a storage container for receiving low or medium activity radioactive waste coated with a filling material.

In the represented embodiment, the container is parallelpipedic and the vessel 210 has a flat bottom **210*b* and the side wall 210*a* a square cross-section, whose upper end defines an opening, which can be tightly sealed by the cover 212**.

According to the invention, the complete container, i.e. drum 210 and cover 212 is made from metal fiber-reinforced concrete. Drum 210 and cover 212 are produced by molding and e.g. have the shapes shown in FIG. 5.

In particular, the upper end of the side wall **210*a* of the drum has a stepped shape successively defining, passing from the exterior towards the interior of the drum, a planar end face 250 and a planar surface 252 parallel to face 250 and set back with respect thereto. Surface 252 is connected to the end face 250 by an inclined, internal peripheral edge 254 forming a Z in cross-section with surface 252 and face 250. The inclined edge 254 steps back progressively outwards on approaching surface 252**, in such a way that said inclined edge forms an angle $\beta$ of at least 10° with the axis of the drum.

Cover 212 also has a stepped peripheral zone, which has, starting from its upper face, an inclined, external peripheral edge 256 and a vertical edge 258 set back from the inclined edge 256. These edges 256 and 258 are connected by a planar surface 260 parallel to the upper and lower faces of the cover. The diameter of the inclined edge 256 steps back progressively outwards on approaching surface 260, in such a way that said inclined edge forms with the axis of cover 212 an angle $\alpha$ of at least 10°. This angle $\alpha$ between the surface 260 and the cover axis is smaller than the angle $\beta$ between the surface 254 and the drum axis. When cover 212 is placed on the drum, the lower part of the cover defined by edge 258 is fitted into the opening formed at the top of the drum until surface 260 bears on surface 252. As can be seen in FIG. 6, the inclined edges 254 and 256, which have the same height, then face one another and define between them a dovetail-shaped annular space, whose width is substantially constant from the upper face of the container to the surface 252. This annular space constitutes a keying groove.

In order to tightly fix the cover 212 on drum 210, a keying joint 224 is cast into said annular space. According to the invention, said keying joint 224 is made from the same material as the rest of the container, i.e. metal fiber-reinforced concrete.

The production of the keying joint 224 is an upwardly open annular space makes it possible to ensure a tight sealing of the container without it being necessary to use a formwork. Moreover, the shape of the keying joint makes it possible to ensure that there is no risk of the cover flying off when this joint is produced.

Advantageously, the cover 212 is centrally provided with at least one opening 228 in which is formed a keying groove 229. In this way, the container can be filled following the sealing of cover 212 on drum 210 by means of the keying joint 224. When the waste has been introduced through opening 228, the filling material is introduced until the opening 228 is completely sealed. By using as the filling material metal fiber-reinforced concrete identical to that forming the actual container, a homogeneous assembly is obtained where there is no cracking and breaking risk.

As in the preceding embodiments, the internal surfaces of the container and the internal surfaces of the groove for receiving the keying joint 224 and the central opening 228 are made rough by any appropriate means, e.g. by cleaning these surfaces using a brushing or roughening device or high pressure water jets.

Tubes for injecting the filling material into the bottom of the vessel can, if appropriate, be embedded in the side wall **210*a*** of the vessel, in the case where the filling is carried out under pressure, in accordance with the teaching of the main patent application.

Finally, in order to permit the handling of the container, various means can be provided. In an exemplified manner, these means can include rods or rings 234 sealed onto the planar end face 250 of the drum. A handling groove or slot 223 can also be formed by molding on the outer peripheral surface of drum 210, close to the end face 250.

Obviously, the invention is not limited to the embodiments described in exemplified manner hereinbefore and in fact covers all variants thereof. In particular, the three embodiments described can be combined in different ways.

Thus, the procedure of molding the cover directly in the drum opening described with reference to FIG. 4 could be applied to non-cylindrical containers. Conversely, the use of keying joints as shown in FIGS. 3 and 5 can also be applied to cylindrical containers. In a comparable way, the shapes of the keying grooves can be reversed. Moreover, cylindrical containers can be equipped with support feet and/or lifting rods. Finally, in the embodiment according to FIG. 4, the fly-off preventing plate 140 can be eliminated when the waste is denser than the filling material.

We claim:

1. A storage container for radioactive waste comprising a drum provided with an opening for introducing the waste and a cover for tightly sealing said opening, said container being totally made from concrete reinforced by metal fibers, said container including a junction zone between the cover and the drum, said junction zone having, around said opening, at least one keying groove, said container also having at least one filling passage by which metal fiber-reinforced concrete can be injected around waste contained in the container wherein the filling passage is formed within a side wall of the drum and issues in the vicinity of the bottom of the latter.

2. A container according to claim 1 including at least one keying joint made from concrete reinforced by metal fibers and simultaneously penetrating a keying groove formed on an upper edge of the drum and into at least one keying groove formed on a peripheral edge of the cover.

3. A container according to claim 2, wherein the keying joint is formed both in the extension of a side wall of the drum and in the extension of the cover.

4. A container according to claim 3, wherein the cover has a centering portion which penetrates said drum opening.

5. A container according to claim 1, wherein each keying groove has a width which increases on moving away from the surface onto which said groove issues.

6. A container according to claim 1, wherein the drum has metal fiber-reinforced concrete support feet projecting from the outer surface of the drum bottom.

7. A container according to claim 1, wherein the inner surface of the drum and cover, as well as the surfaces defining the junction zone are rough surfaces.

8. A container according to claim 1, wherein the metal fibers are fibers chosen from the group including cast iron, steel, stainless steel and galvanized steel.

9. A container according to claim 1, further includes a lifting means wherein said lifting means are mounted on an upper edge of the drum.

10. A storage container for radioactive waste comprising a drum provided with an opening for introducing the waste and a cover for tightly sealing said opening, said container being totally made from concrete reinforced by metal fibers, said container including a junction zone between the cover and the drum, said junction zone having, around said opening, at least one keying groove, said container also having at least one filling passage by which metal fiber-reinforced concrete can be injected around waste contained in the container wherein a metal fiber-reinforced concrete fly-off preventing plate is latched in the keying groove formed in said opening of the drum and set back with respect to the cover, the filling passage being formed in the fly-off preventing plate.

11. A container according to claim 10, wherein the cover is cast directly into said opening of the drum and enters said keying groove.

12. A container according to claim 11, wherein the keying groove is formed in an inner surface of said drum facing said opening.

13. A container according to claim 10, further includes a handling slot formed on an outer peripheral surface of the drum.

14. A container according to claim 10, wherein the inner surface of the drum and cover, as well as the surfaces defining the junction zone are rough surfaces.

15. A container according to claim 10, wherein the metal fibers are fibers chosen from the group including cast iron, steel, stainless steel and galvanized steel.

16. A storage container for radioactive waste comprising a drum provided with an opening for introducing the waste and a cover for tightly sealing said opening, said container being totally made from concrete reinforced by metal fibers, said container including a junction zone between the cover and the drum, said junction zone having, around said opening, at least one keying groove wherein each keying groove constituted by a dovetail space is formed between an outer peripheral edge of the cover and an inner peripheral edge of the drum surrounding said opening, a metal fiber-reinforced keying joint being cast in said space.

17. A container according to claim 16, wherein the outer peripheral edge of the cover and the inner peripheral edge of the drum step back progressively outwards on moving away from an upper surface of the cover and an end face of the drum, so as to bring about a self-locking of the cover by the keying joint.

18. A container according to claim 16, wherein the inner surfaces of the drum and cover, as well as the surfaces defining the junction zone are rough surfaces.

19. A container according to claim 16, wherein the metal fibers are fibers chosen from the group including cast iron, steel, stainless steel and galvanized steel.

20. A container according to claim 16, further include handling slot formed on an outer peripheral surface of the drum.

* * * * *